United States Patent [19]

Clerc et al.

[11] 4,429,250

[45] Jan. 31, 1984

[54] DIRECT HEATING CATHODE FOR HIGH FREQUENCY THERMIONIC TUBE

[75] Inventors: Guy Clerc; Arvind Shroff, both of Paris, France

[73] Assignee: Thomson-CSF, Paris, France

[21] Appl. No.: 303,464

[22] Filed: Sep. 18, 1981

Related U.S. Application Data

[63] Continuation of Ser. No. 105,506, Dec. 20, 1979, abandoned.

[30] Foreign Application Priority Data

Dec. 27, 1978 [FR] France ..... 78 36487

[51] Int. Cl.[3] ..... H01J 1/16

[52] U.S. Cl. ..... 313/336; 313/346 R

[58] Field of Search ..... 313/336, 346 R, 346 DC

[56] References Cited

U.S. PATENT DOCUMENTS

| | | | |
|---|---|---|---|
| 4,137,476 | 1/1979 | Ishii et al. | 313/336 |
| 4,178,530 | 12/1979 | Lersmacher et al. | 313/346 R |
| 4,274,030 | 6/1981 | Buxbaum | 313/346 R |
| 4,313,854 | 2/1982 | Sunahara et al. | 313/346 R |

*Primary Examiner*—Harold Dixon

*Attorney, Agent, or Firm*—Roland Plottel

[57] ABSTRACT

A direct heating thermionic emission cathode for high frequency tubes of the diode, tetrode or pentode type. It comprises a pyrolytic graphite support and a lanthanum hexaboride-based thermoemissive material, these elements being separated by a layer which constitutes a diffusion barrier and comprises a tantalum or hafnium carbide, a metal of the platinum group or a boron compound.

9 Claims, 2 Drawing Figures

DIRECT HEATING CATHODE FOR HIGH FREQUENCY THERMIONIC TUBE

This application is a continuation of application Ser. No. 105,506, filed Dec. 20, 1979, now abondoned.

BACKGROUND OF THE INVENTION

The present invention relates to a cathode for a high frequency thermionic tube and more particularly to a thermionic emission cathode with direct heating.

In high frequency thermionic tubes of the triode, tetrode or pentode type having a cathode, an anode and one, two or three grids it is advantageous to make the grids from pyrolytic graphite, a material well known for its mechanical and thermal properties. However, in said same tubes the cathodes are generally in the form of thoriated tungsten filaments for thermionic emissivity reasons. Thus, in operation there are mechanical problems due to the differences in the thermal behaviour of these materials. These problems are only inadequately solved by costly mechanical assemblies or by constraining conditions of using the tubes, such as for example the permanent ignition of the cathodes.

BRIEF SUMMARY OF THE INVENTION

The present invention relates to a cathode, which obviates thermomechanical problems within the tube, whilst ensuring a good thermionic emissivity. To this end it has a support made from pyrolytic graphite and a lanthanum hexaboride-based thermoemissive material, the support and the thermoemissive material being separated by a layer constituting a diffusion barrier between said two elements.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
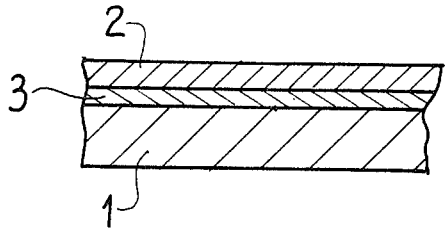
FIG. 1 in cross-section an embodiment of the cathode according to the invention.

In the drawings the same references relate to the same elements.

Thus, FIG. 1 shows a first embodiment of the cathode according to the invention, in which it has three elements, namely a support 1, preferably made from pyrolytic graphite, a layer 2 of an emissive material and an intermediate layer 3, forming a diffusion barrier between elements 1 and 2.

With respect to support 1 pyrolytic graphite is preferred compared with other materials for two main reasons. The first reason is related to the qualities of the actual pyrolytic graphite, which is not isotropic and in the deposition plane has a relatively good electrical conductivity and a very good thermal conductivity, whilst in a direction perpendicular to the deposition its conductivity values are low. Moreover, it has low expansion coefficients and good high temperature mechanical properties, making it possible to directly heat the cathode by current circulation in support 1 up to temperatures of for example 1,000° to 2,000° C. The second reason relates to the insertion of the cathode in a thermionic tube having one or more grids, which are themselves made from pyrolytic graphite. The use of the same material for the cathode and the grids leads to a better geometrical definition of the internal structure of the tube.

The layer 2 of emissive material is made necessary by the choice of graphite for the support 1. Thus, graphite is a poor thermionic emitter, the work function of an electron being of the order of 4.7 eV. For this reason on the surface thereof is placed a good emitting material 2, such as a boron compound of lanthanides, for example lanthanum hexaboride ($LaB_6$) or a mixture of lanthanum hexaboride and another material making it possible to further reduce the work function, such as another lanthanide.

The advantage of compounds of this type is that they are good emitters at lower temperatures than other known emissive materials. A lanthanum hexaboride cathode can be used at temperatures of about 1,300° to 1,600° C., whereas the temperature is 1,900° to 2,000° C. in the case of a cathode made from tungsten or thoriated tungsten, materials frequently used for this purpose.

However, a disadvantage of such materials for making the emissive layer 2 is their very considerable chemical activity with respect to the graphite when hot. For example in the case of $LaB_6$ this leads to the formation of boron carbide and the release of lanthanum, which has a high vapour tension compared with that of lanthanum hexaboride, in accordance with the following reaction:

$$4LaB_6+6C \rightarrow 6B_4C+4La$$

which leads to the destruction of the cathode.

To obviate this phenomenon a layer 3 is placed between element 1 and 2 in order to isolate the carbon atoms from the lanthanum hexaboride atoms.

Two solutions are possible for preventing the above reaction. According to a first embodiment a layer 3 of a material having no chemical reaction with carbon and lanthanum hexaboride is deposited, this being constituted for example by a metal in the platinum family, such as platinum, osmium, rhenium or iridium. According to a second embodiment the intermediate layer 3 is formed by a boron compound of a transition metal of groups IV B (titanium, zirconium or hafnium) and V B (niobium or tantalum for example) of the periodic chart of the elements. The diborides of these substances are stable and the occupation of the interstitial sites of the metal by boron atoms prevents the diffusion of boron atoms belonging to the emissive layer 2.

According to a variant embodiment, when it is no longer necessary to prevent the above-mentioned chemical reaction, but only to retard it in the case, for example, where the life of the tube is limited the intermediate layer 3 can be formed by a stable carbide, for example of tantalum (TaC) or hafniun (HfC).

With regard to the technological realisation of the cathode according to the invention a pyrolytic graphite support 1 is used, which is machined by any known means to form a hollow cylinder, which may or may not have a meshed structure, whose conductivity is maximum parallel to the cylinder axis. For example the thickness of this support is between 0.2 and 1 mm. This support is supplied by power supply means, which are also made from graphite.

The intermediate layer 3 is deposited on support 1 by evaporation, cathodic sputtering, electrolysis or by the vapour phase. Its thickness is preferably between 5 and 20 μm.

The emissive layer 2 is deposited on the layer 3 by means of a brush, gun, electrophoresis, cathodic sputtering, vacuum evaporation or ionic deposition. Its thickness is preferably between 0.04 and 0.1 mm.

Figure 2:
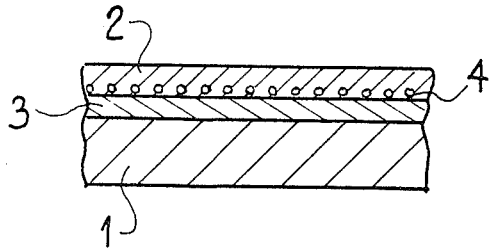
FIG. 2 a variant embodiment of the cathode of FIG. 1.

FIG. 2 shows a variant embodiment of the cathode according to the invention. Once again there is a pyrolytic graphite layer 1 on which is deposited the intermediate layer 3, in the manner described hereinbefore. However, in FIG. 2 powder 4 of a metal from the platinum group (iridium or rhenium preferably) is fritted to the surface of layer 3 in order to improve the adhesion of the lanthanum hexaboride emissive layer 2 to the intermediate layer 3.

What is claimed is:

1. A direct heating cathode for a radio frequency electron tube, comprising a hollow cylinder pyrolytic graphite supports; a lanthanum hexaboride-based thermoemissive material layer; and an intermediate layer separating said support and said thermoemissive material, said intermediate layer comprising a diboride of a metal selected from the group titanium, zirconium, hafnium, niobium and tantalum and forming a diffusion barrier for the atoms forming said support and said thermoemissive material layer, and is made of a material which does not react chemically with carbon or boron.

2. A cathode according to claim 1, wherein said non-reactive material is made of one metal selected in the following group: platinum, osmium, rhenium and iridium.

3. A cathode according to claim 1, wherein the intermediate layer is constituted by a boron compound and one of the metals of groups IV B and V B of the periodic chart of the elements.

4. A cathode according to claim 1, wherein said intermediate layer is constituted by a stable carbide.

5. A cathode according to claim 4, wherein said carbide is a tantalum or hafnium carbide.

6. A cathode according to claim 1, wherein the thermoemissive material is made of a mixture of lanthanum hexaboride and another lanthanide.

7. A cathode according to claim 1, wherein said intermediate layer comprises a layer of a powder of a material which does not react with carbon and boron, fritted to the surface of the intermediate layer and on which is deposited the emissive layer, said layer of powder improves the adhesion of the lanthanum hexaboride emissive layer to the intermediate layer.

8. A cathode according to claim 7, wherein said powder layer is made of rhenium or iridium.

9. A cathode according to claim 1, wherein said intermediate layer is selected from the group of hafnium diboride and hafnium carbide.

* * * * *